United States Patent [19]

Scannell

[11] 4,038,085

[45] July 26, 1977

[54] METHOD OF TREATING ELECTROLESS NICKEL PLATING BATH

[75] Inventor: William G. Scannell, Hinsdale, Ill.

[73] Assignee: Chromium Industries, Inc., Chicago, Ill.

[21] Appl. No.: 663,264

[22] Filed: Mar. 3, 1976

[51] Int. Cl.[2] ..... C23C 3/02

[52] U.S. Cl. ..... 106/1; 427/438

[58] Field of Search ..... 106/1; 427/438

[56] References Cited

U.S. PATENT DOCUMENTS

| | | | |
|---|---|---|---|
| 2,532,283 | 12/1950 | Brenner et al. | 106/1 |
| 2,886,451 | 5/1959 | Budininkas | 106/1 |
| 2,886,452 | 5/1959 | Duvall | 106/1 |
| 2,916,401 | 12/1959 | Puls et al. | 106/1 |
| 3,340,073 | 9/1967 | Zirngiebl et al. | 106/1 |

*Primary Examiner*—Lorenzo B. Hayes

*Attorney, Agent, or Firm*—Laff, Whitesel & Rockman

[57] ABSTRACT

The invention resides in the addition of large quantities of sodium fluoride to a chemical plating solution for depositing nickel on a catalytic substrate. The purpose of the addition is to increase the rate of deposition of an electroless nickel plating bath. In this way, heavy deposits may be made on substrates without substantial surface roughness, the control and integrity of the properties of the bath can be better maintained, concentrations of additives needed to maintain control of bath properties can be reduced, and the life of the plating bath can be extended.

4 Claims, No Drawings

METHOD OF TREATING ELECTROLESS NICKEL PLATING BATH

BACKGROUND THE INVENTION

This invention relates to processes for regenerating solutions used in electroless chemical nickel plating, and more particularly to processes for precipitating out contaminants in the plating solution.

Electroless chemical nickel plating is known and has been used for a substantial period of time. The chemical nickel plating solution usually includes an aqueous solution of nickel cations and hypophosphite anions, derived from nickel sulfate, nickel chloride, and sodium hypophosphite.

The process of chemical nickel plating involves the reduction of a nickel salt to metallic nickel and the corresponding oxidation of a reducing agent, such as a hypophosphite. The material to be plated, which is a ferrous or non-ferrous material, is prepared and is immersed in an aqueous acid bath containing the nickel cations and hypophosphite anions. The reduction of the nickel cations and corresponding oxidation of the hypophosphite is believed to cause the formation of phosphite anions, which form nickel orthophosphite, a relatively insoluble material. The presence of orthophosphite solid particles in the bath results in rough deposits and slows down the rate of deposition, two undesirable effects. Because of the characteristics of the orthophosphite solid particles, they cannot be filtered or otherwise mechanically removed from the bath in a practical manner. Therefore, the orthophosphite build-up will eventually contaminate the bath so that it must be discarded. Since the cost of a nickel plating bath is considerable, extending the bath life is a desirable and important consideration.

In order to prevent early precipitation of the orthophosphites, complexing or chelating agents may be used to form nickel complexes and tie up the nickel ions in a substantially undissociable molecule. Since these chelating agents tend to slow down the deposition rate, certain anions (exaltants) are also added to the bath to increase the plating rate. One agent which acts both as a complexing agent and exaltant is sodium fluoride.

Until the present, when sodium fluoride was added to a plating bath, only small quantities were employed, in the nature of 0.01 to 0.04 moles/liter. See, e.g., U.S. Pat. Nos. 2,694,017 and 2,694,019.

SUMMARY OF THE INVENTION

The present invention involves the addition of large quantities of sodium fluoride to a standard electroless nickel plating bath. For example, the periodic addition of relatively large amounts of sodium fluoride, e.g., a minimum amount of about 150 pounds of fluoride to a 4500 gallon bath, (1) permits consistent maintenance of the control and integrity of the bath and extends the bath life for an indefinite period, (2) allows heavy deposits (e.g., 0.010 inch) to be made without roughness, and (3) reduces the concentrations of additives needed to maintain control of the bath properties. The fluoride salt is added when roughness begins to appear on the plating workpieces, when the plating rate falls below a predetermined level, or when the pH of the plating solution becomes too low. When the fluoride salt is added, a precipitate is formed which settles to the bottom of the bath tank. The bath can then be transferred from the plating tank to a storage facility, the precipitate removed from the plating tank, and a regenerated bath then returned to the plating tank.

DETAILED DESCRIPTION OF THE INVENTION

A chemical plating solution which can be used in this invention includes:

1. An aqueous solution of nickel ions in concentrations of about 1.5 ounces per gallon, wherein the nickel ions may be obtained from nickel sulfate ($NiSo_4 . 6H_2O$) dissolved in water;
2. sodium hypophosphite in concentrations of about 2.7 ounces per gallon or approximately 1.8 times the concentration of nickel ions;
3. sodium acetate or sodium citrate in an amount equal to about 1 to 1.5 ounces per gallon; and
4. lactic acid or glycolic acid (polyhydroxy acetic acid) in amounts sufficient to adjust the pH to about 5, which has been found to be an optimum operating point.

The plating solution will be operated within a pH range of 3.5 to 6, depending upon the amount of single nickel salts used and whether or not boric acid is added to the solution. The addition of boric acid is optional. When used in amounts of about 1 to 1.5 ounces per gallon, the boric acid may afford additional ductility to the nickel plate and may aid in pH control by acting as a buffering agent.

The plating solution is operated at temperatures of about 108° to 185° F. Once the plating solution is used, the pH of the solution decreases rapidly to as low as 3.5 and the rate of deposition to 0.0002 inches of nickel per hour. While in many plating operations the plating bath can operate at this rate for an extended period of time, it may not be practical to operate at this rate when heavy deposits, such as 0.008 to 0.010 inches of nickel are required.

In order to increase the plating rate of the solution to as much as 0.001–0.0015 inches per hour, the pH must be adjusted upward to 4.5 to 4.6 and maintained at that level. This can be done by adding ammonium hydroxide in the presence of lactic acid, or glycolic acid. Where the latter are not present, a precipitate or impurity will be formed and the nickel will plate on to the precipitate causing the bath to deplete rapidly and uncontrollably.

It is believed that the precipitate or impurity is a by-product of the reduction of nickel with hypophosphite called orthophosphite. When the presence of these orthophosphite particles in the bath slows down the plating rate until it becomes less than 0.0003 inches per hour, it not only becomes impractical to keep the plating solution in operation, but also the alloy of nickel and phosphorus deposited becomes too unlike the alloy deposited from a bath which is plating at a rate of 0.0004 inches – 0.0008 inches per hour. The nickel-phosphorous alloy is too hard, exhibits porosity, and is difficult, if not impossible, to polish to a pit-free, low R.M.S. finish.

To maintain the bath integrity and increase the rate of deposition, relatively large quantities of sodium fluoride are added to the plating solution when the rate of deposition falls below about 0.0002 inches of nickel per hour, and when normal adjustment of the nickel to hypophosphite fails to cause an increase in the plating rate. The sodium fluoride must be added in quantities of about 0.53 ounces per gallon. Thus, in a 4500 gallon bath, a minimum of 150 pounds of sodium fluoride must be added, and it should all be added at the same time. If all of the sodium fluoride is not added to the solution at the same time, the reaction which results in the precipitate may not be complete, and precipitation may be incomplete.

The addition of the fluoride will cause a white precipitate to form which can be filtered from the solution. The precipitate will not be plated with nickel. Since the concentration of the precipitate will increase as the temperature of the solution is increased, the temperature is raised to about 190°–195° F. after the fluoride is added. The solution may then be filtered at the elevated temperature and dropped back to the lower operating temperature (180°–185° F.) for a clear plating solution. Since the addition of sodium fluoride does not affect plating, the addition can be made while the plating solution is operating.

After the precipitate is formed and removed from the solution, there is no significant change, either in the hypophosphite concentration or in the nickel concentration, as compared to the concentrations existing prior to formation and removal of the precipitate.

The sodium fluoride may be added to the solution at a pH of 3.5 and the pH may thereafter be raised as high as 6.

It should be noted that the addition of large quantities of sodium fluoride to a new bath will not increase the plating rate.

What is claimed is:

1. The method of treating a chemical nickel plating solution during the plating process to maintain solution integrity and increase the plating rate, said solution including an aqueous solution of nickel ions in concentrations of about 1.5 ounces per gallon of solution, sodium hypophosphite in concentrations of about 2.7 ounces per gallon of solution, a compound selected from the group consisting of sodium acetate and sodium citrate in concentrations of about 1–1.5 ounces per gallon of solution, and a compound selected from the group consisting of lactic acid and glycolic acid in amounts sufficient to adjust the pH of the solution to about 5, said method comprising: adding to the solution sodium fluoride in quantities of not less than about 0.5 ounces per gallon of solution sufficient to cause the formation of a precipitate; and filtering the precipitate from the solution whereby the control and integrity of the bath are maintained.

2. The process of claim 1 wherein all of the sodium fluoride is added at the same time.

3. The process of claim 2 wherein the temperature of the plating solution is maintained at a range of 180°–185° F., until the sodium fluoride is added; the temperature of the plating solution is raised to about 190° F. after the sodium fluoride is added whereby the precipitate is formed more rapidly; and, after the precipitate is filtered from the solution, the temperature of the solution is reduced to the initial range of 180° F. to 185° F.

4. The process of claim 3 wherein the sodium fluoride is added to the plating solution when the pH of the solution decreases to 3.5 or lower or the rate of deposition decreases to less than 0.0003 inches of nickel per hour, and where adjustment of pH to normal operating range has no affect on the plating rate to increase the plating rate to the practical range.

* * * * *

UNITED STATES PATENT AND TRADEMARK OFFICE

CERTIFICATE OF CORRECTION

PATENT NO. : 4,038,085

DATED : July 26, 1977

INVENTOR(S) : William G. Scannell

It is certified that error appears in the above-identified patent and that said Letters Patent are hereby corrected as shown below:

Col. 1, Line 4 (Heading), --of-- should be inserted between "background" and "the"

Col. 2, Line 30, "108°" should be --180°--

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*